US007857061B2

(12) United States Patent
Richards

(10) Patent No.: US 7,857,061 B2
(45) Date of Patent: Dec. 28, 2010

(54) FLOW CONTROL IN A WELL BORE

(75) Inventor: William Mark Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 78 days.

(21) Appl. No.: 12/123,682

(22) Filed: May 20, 2008

(65) Prior Publication Data

US 2009/0288838 A1 Nov. 26, 2009

(51) Int. Cl.
*E21B 34/06* (2006.01)

(52) U.S. Cl. ..... 166/373; 166/317; 166/334.4

(58) Field of Classification Search ..... 166/373, 166/386, 317, 334.4, 332.1
See application file for complete search history.

(56) References Cited

U.S. PATENT DOCUMENTS

| | | | |
|---|---|---|---|
| 64,332 | A | 4/1867 | Knapp et al. |
| 2,046,460 | A | 7/1936 | Johnson |
| 2,567,321 | A | 9/1951 | Courter |
| 2,925,866 | A | 2/1960 | Arterbury |
| 3,180,419 | A | 4/1965 | Cochran et al. |
| 3,358,760 | A | 12/1967 | Blagg |
| 3,385,364 | A | 5/1968 | Whitten |
| 3,396,796 | A | 8/1968 | Voetter |
| 4,535,842 | A | 8/1985 | Ross |
| 4,745,971 | A | 5/1988 | Akkerman |
| 5,058,674 | A | 10/1991 | Schultz et al. |
| 5,103,906 | A | 4/1992 | Schultz et al. |
| 5,337,808 | A | 8/1994 | Graham |
| 5,431,412 | A | 7/1995 | Reinhardt et al. |
| 5,435,393 | A | 7/1995 | Brekke et al. |
| 5,549,161 | A | 8/1996 | Gomez et al. |
| 5,727,632 | A | 3/1998 | Richards |
| 5,803,179 | A | 9/1998 | Echols et al. |
| 5,896,928 | A | 4/1999 | Coon |

(Continued)

FOREIGN PATENT DOCUMENTS

EP 1857633 A2 11/2007

(Continued)

OTHER PUBLICATIONS

Brochure, Sand Control, Poro Max Screens, Maximizing Performance and Value, copyright 2005 Halliburton, 2 pages.

(Continued)

*Primary Examiner*—William P Neuder
(74) *Attorney, Agent, or Firm*—Joshua A. Griswold

(57) ABSTRACT

A system for installation in a well bore includes a flow control device and a control unit coupled to the flow control device. The flow control device is changeable from a first state to a second state. The first state corresponds to a first mode of fluid communication between an interior of a tubular conduit of a completion string and an annulus between the tubular conduit and a wall of the well bore. The second state corresponds to a second, different mode of fluid communication between the interior of the tubular conduit and the annulus. The control unit is coupled to the flow control device to change the flow control device between the first and second states. The control unit is actuated to change the flow control device in response to pressure in the well bore.

21 Claims, 9 Drawing Sheets

U.S. PATENT DOCUMENTS

| | | | | |
|---|---|---|---|---|
| 5,918,689 | A | 7/1999 | Roberts | |
| 6,112,815 | A | 9/2000 | Boe et al. | |
| 6,302,208 | B1 | 10/2001 | Walker et al. | |
| 6,371,210 | B1 | 4/2002 | Bode et al. | |
| 6,470,970 | B1 | 10/2002 | Purkis et al. | |
| 6,575,237 | B2 | 6/2003 | Purkis et al. | |
| 6,585,051 | B2 | 7/2003 | Purkis et al. | |
| 6,659,184 | B1 | 12/2003 | Tips et al. | |
| 6,857,476 | B2 | 2/2005 | Richards | |
| 6,883,613 | B2 | 4/2005 | Bode et al. | |
| 6,886,634 | B2 | 5/2005 | Richards | |
| 6,978,842 | B2 | 12/2005 | Read et al. | |
| 7,013,980 | B2 | 3/2006 | Purkis et al. | |
| 7,096,945 | B2 | 8/2006 | Richards et al. | |
| 7,145,471 | B2 | 12/2006 | Purkis et al. | |
| 7,191,833 | B2 | 3/2007 | Richards | |
| 7,240,737 | B2 | 7/2007 | Tips et al. | |
| 7,325,597 | B2 | 2/2008 | Ringgenberg et al. | |
| 7,426,962 | B2 | 9/2008 | Moen et al. | |
| 7,484,566 | B2 | 2/2009 | Tips et al. | |
| 7,503,385 | B2 | 3/2009 | Tips et al. | |
| 7,503,389 | B2 | 3/2009 | Delaloye et al. | |
| 7,537,056 | B2 | 5/2009 | MacDougall | |
| 7,597,150 | B2 * | 10/2009 | Clem | 166/334.4 |
| 2006/0213671 | A1 | 9/2006 | Li et al. | |
| 2007/0114043 | A1 | 5/2007 | Richards et al. | |
| 2007/0246210 | A1 | 10/2007 | Richards | |
| 2007/0246212 | A1 | 10/2007 | Richards | |
| 2007/0246407 | A1 | 10/2007 | Richards et al. | |
| 2008/0035330 | A1 | 2/2008 | Richards | |
| 2008/0041580 | A1 | 2/2008 | Freyer et al. | |
| 2008/0041581 | A1 | 2/2008 | Richards | |
| 2008/0041588 | A1 | 2/2008 | Richards et al. | |
| 2008/0236844 | A1 | 10/2008 | Gaudette et al. | |
| 2008/0264628 | A1 | 10/2008 | Coronado et al. | |
| 2009/0084556 | A1 * | 4/2009 | Richards et al. | 166/329 |
| 2009/0133869 | A1 | 5/2009 | Clem | |
| 2009/0133874 | A1 | 5/2009 | Dale et al. | |
| 2009/0133875 | A1 | 5/2009 | Tibbles et al. | |
| 2009/0133882 | A1 | 5/2009 | Delaloye et al. | |
| 2009/0151925 | A1 * | 6/2009 | Richards et al. | 166/53 |
| 2009/0205833 | A1 * | 8/2009 | Bunnell et al. | 166/373 |

FOREIGN PATENT DOCUMENTS

| | | | |
|---|---|---|---|
| GB | 2455001 | A | 5/2009 |
| WO | WO 02/075110 | A1 | 9/2002 |
| WO | WO03023185 | A1 | 3/2003 |
| WO | WO2004072432 | A2 | 8/2004 |
| WO | WO 2008/063947 | | 5/2008 |
| WO | 2009/048822 | A2 | 4/2009 |
| WO | 2009/048822 | A3 | 4/2009 |
| WO | 2009/048823 | A2 | 4/2009 |
| WO | 2009/048823 | A3 | 4/2009 |
| WO | 2009/067021 | A2 | 5/2009 |
| WO | WO2009065793 | A1 | 5/2009 |
| WO | WO2009065890 | A1 | 5/2009 |
| WO | WO2009066097 | A1 | 5/2009 |

OTHER PUBLICATIONS

Brochure, Completion Tools, Hydrostatic-Set Packers, High-Performance, Single-Trip Production Packers, copyright 2006 Halliburton, 2 pages.

International Search Report and Written Opinion for PCT/US2009/044531 dated Jan. 28, 2010, (13 pages).

* cited by examiner

FLOW CONTROL IN A WELL BORE

BACKGROUND

The present disclosure relates to well systems, and more particularly to controlling flow in well systems.

It is often desirable to control fluid flow into the completion string of a well system, for example, to balance inflow of fluids along the length of the well. For instance, some horizontal wells have issues with the heel-toe effect, where gas or water cones in the heel of the well and causes a difference in fluid influx along the length of the well. The differences in fluid influx can lead to premature gas or water break through, significantly reducing the production from the reservoir. Inflow control devices (ICD) can be positioned in the completion string at heel of the well to stimulate inflow at the toe and balance fluid inflow along the length of the well. In another example, different zones of the formation accessed by the well can produce at different rates. ICDs can be placed in the completion string to reduce production from high producing zones, and thus stimulate production from low or non-producing zones. Finally, ICDs can be used in other circumstances to balance or otherwise control fluid inflow.

SUMMARY

In a general aspect, a flow control device is changeable from a first state to a second state, and a control unit is coupled to the flow control device to change the flow control device between the first and second states.

In one aspect, a system for installation in a well bore includes the flow control device and the control unit coupled to the flow control device. The flow control device is changeable from a first state to a second state. The first state corresponds to a first mode of fluid communication between an interior of a tubular conduit of a completion string and an annulus between the tubular conduit and a wall of the well bore. The second state corresponds to a second, different mode of fluid communication between the interior of the tubular conduit and the annulus. The control unit is coupled to the flow control device to change the flow control device between the first and second states. The control unit is actuated to change the flow control device in response to pressure in the well bore.

In one aspect, a method of reconfiguring production inflow comprises producing fluids from an annulus about a completion string through a sand screen and into an interior of the completion string via a flow path, and the flow path is reconfigured in response to a hydraulic signal.

In one aspect, pressure is applied in a wellbore. In response to the applied pressure, a state of the flow control device in a completion string installed in the wellbore is changed from a first state to a second state. The first state corresponds to a first mode of fluid communication between an interior of the tubular conduit and the annulus between the tubular conduit and a wall of the well bore. The second state corresponds to a second, different mode of fluid communication between the interior of the tubular conduit and the annulus.

One or more embodiments may include one or more of the following features, alone or in combination. The control unit is actuated to change the flow control device in response to pressure in the tubular conduit exceeding a specified pressure. The control unit is actuated to change the flow control device in response to pressure in the tubular conduit below a specified pressure. The control unit includes a hydraulic chamber in communication with the interior of the tubular conduit. The control unit includes a piston in communication with the hydraulic chamber and coupled to the flow control device. Pressure in the hydraulic chamber moves the piston and moving the piston changes the flow control device from the first state to the second state. Rupturing of a rupture disk between the hydraulic chamber and the interior of the tubular conduit allows fluid from the interior of tubular conduit into the hydrostatic chamber when the pressure in the tubular conduit exceeds the specified pressure. The first state of the flow control device allows fluid from the annulus to flow along a first flow path of the flow control device into the tubular conduit. The first state of the flow control device allows fluid from the tubular conduit to flow along a first flow path of the flow control device into the annulus. The second state of the flow control device allows fluid from the annulus to flow along a second flow path into the tubular conduit. The second flow path is less flow restrictive than the first flow path. The second flow path is more flow restrictive than the first flow path. The first state of the flow control device prevents fluid flow from the annulus into the tubular conduit and the second state of the flow control device allows fluid flow from the annulus into the tubular conduit. An additional flow control device is changeable between a plurality of states and provides one or more flow paths between the annulus and the interior of the tubular conduit. The control unit is coupled to the additional flow control device to change the additional flow control device between the states in response to pressure in the tubular conduit exceeding a specified pressure. In some cases, a second flow control device and a second control unit are included. The second control unit is coupled to the second flow control device to change the second flow control device between a first and a second state. The second control unit is actuated to change the second flow control device in response to pressure in the tubular conduit exceeding a second specified pressure that is higher than the first mentioned specified pressure. In some cases, the control unit resides below a packer of the completion string. The flow control device includes a sand screen. The sand screen filters particulates in the annulus from entering the tubular conduit. The flow control device includes a check valve. The check valve allows fluid to flow from the annulus into the tubular conduit and prevents a flow of fluid from the tubular conduit into the annulus. Changing the state of the flow control device includes communicating a volume of fluid to the flow control device. Changing the state of the flow control device is prevented prior to rupturing a rupture disk, and the rupture disk is configured to rupture in response to the specified pressure. The first state of the flow control device seals against flow of fluid through the flow control device between the interior of the tubular conduit and the annulus. A second pressure is applied in an interior of the tubular conduit of the completion string. The second pressure exceeds a second specified pressure that is higher than the first specified pressure. A state of a second flow control device in the completion string is changed from a first state to a second state when the pressure in the interior of the tubular conduit exceeds the second specified pressure. The flow path is reconfigured without well intervention.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

The ability to reconfigure components of a well system without well intervention may simplify and/or reduce the cost of producing resources from the well system. For example, it may be desirable, in some circumstances, to change the rate of fluid flow into one or more sections of a completion string of a well system by opening, closing, or otherwise reconfiguring flow paths between the interior of the completion string and an annulus region (i.e. the region between the completion string and the wall of a well bore). Reconfiguring flow paths by well intervention may require the use of expensive equipment and the consumption of valuable resources (e.g. time and money).

According to the present disclosure, a flow control system reconfigures components of a well system reducing or eliminating the need for well intervention. In some instances, the flow control system may be used to improve the production performance of the well system and/or reduce costs associated with reconfiguring (e.g. opening, closing, and/or otherwise modifying) flow paths into the completion string of the well system. In particular, some configurations of the flow control system of the present disclosure may be used, for example, to open or close bypass valves, to open or close inflow control devices (ICDs), or to modify flow rates through ICDs. In some instances, changes to the flow control system may be implemented without the use of control lines extending up to the well head.

Various embodiments of the concepts disclosed herein may be utilized in various orientations and in various configurations. Example orientations include inclined, inverted, horizontal, vertical, and others. The concepts of this patent application are not limited to any of the example embodiments disclosed herein.

Directional terms are used to describe the example embodiments. Example directional terms include "above," "below," "upper," "lower," and others. The terms "above," "upper," and "upward" may refer to a direction toward the earth's surface along a well bore. The terms "below," "lower," and "downward" may refer to a direction away from the earth's surface along a well bore.

Figure 1:
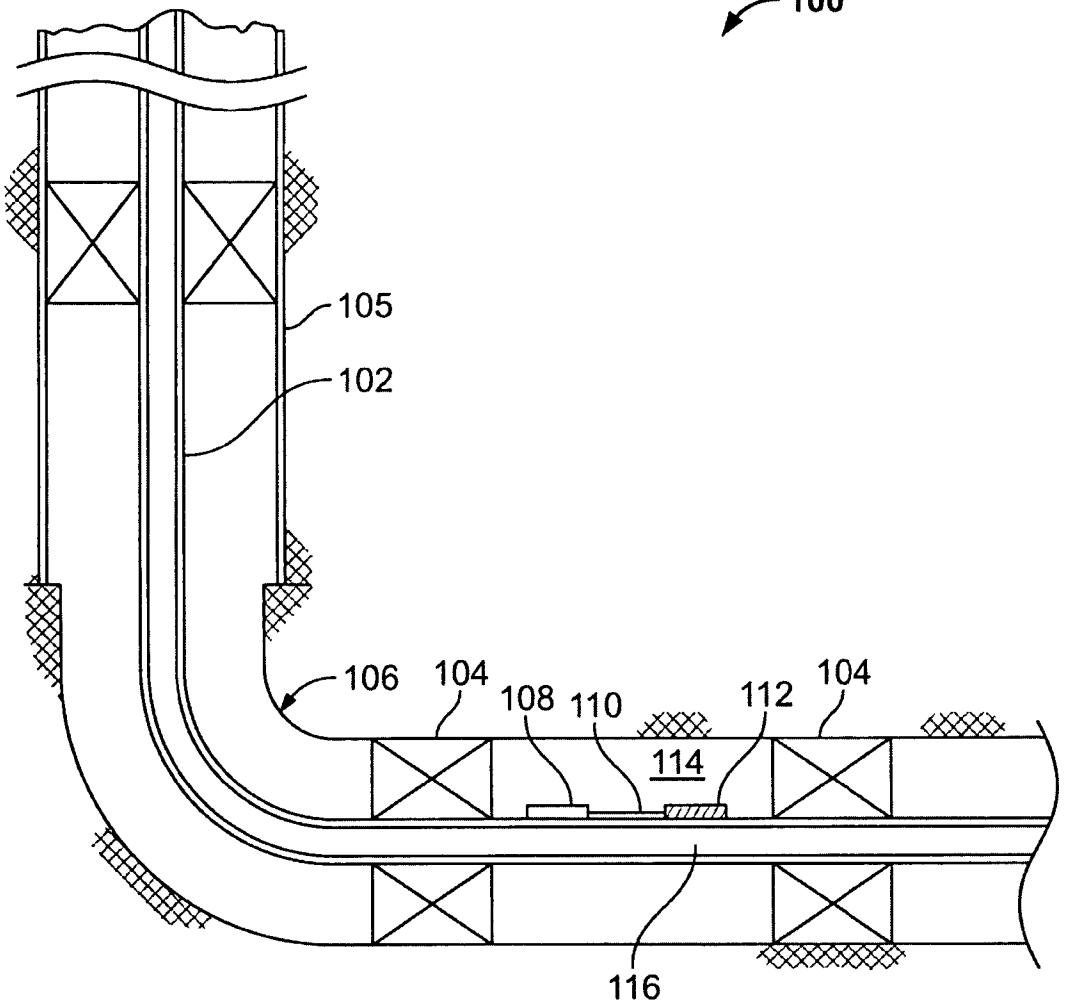
FIG. 1 is a diagram illustrating a well system in accordance with some aspects of the present disclosure.

FIG. 1 is a diagram illustrating an example well system 100. At a high level, the well system 100 includes a completion string 102 and one or more production packers 104 (three shown) installed in a well bore 106. The completion string 102 is an assembly of equipment that includes a tubular conduit and extends through all or a portion of the well bore 106. The completion string 102 may be separate from or anchored to a casing 105 of the well bore 106. The completion string 102 is permanently or semi-permanently installed in the well bore 106, and is the primary equipment used to produce the well over its expected life. The packers 104 seal or substantially seal against passage of fluids between a wall of the well bore 106 and the completion string 102, and thus isolate portions of the well bore 106 from other portions of the well bore 106. FIG. 1 shows a completion string 102 having a flow control system with one control unit 108 and one flow control device 112. The control unit 108 is communicably connected to the flow control device 112 by a control line 110. In certain instances, the flow control system can include more than one control unit 108 and/or more than one flow control device 112. In certain instances, one control unit 108 can be communicably connected to multiple flow control devices 112.

The flow control device 112 may be a device that provides one or more flow paths between the interior region 116 of the completion string 102 and the annulus 114 between the completion string 102 and the wall of the well bore 106. The flow control device 112 may be changeable between a plurality of states, where each state corresponds to a mode of fluid communication between the interior region 116 and the annulus 114. In some examples, a state of the flow control device 112 corresponds to one or more particular flow paths through the flow control device 112 being open, one or more particular flow paths through the flow control device 112 being closed and/or one or more particular flow paths through the flow control device 112 being restricted (i.e. allowing less flow than when open). The control unit 108 may be used to change the flow control device 112 from one of the plurality of states to a different one of the plurality of states. The control unit 108 and the flow control device 112 may communicate over the control line 110. The control line 110 may, for example, be a hydraulic control line that communicates fluid between the control unit 108 and the flow control device 112 in order to change the state of the flow control device 112. FIGS. 2A, 2B, 3A, 3B, and 6 are diagrams illustrating example flow control devices 112 in accordance with some aspects of the present disclosure. The flow control device 112 is not limited to any of the particular features or arrangement of features included in the illustrated examples.

In some cases, a particular state of the flow control device allows fluid from the annulus 114 to flow along a flow path of the flow control device into the tubular conduit. In some cases, a particular state of the flow control device allows fluid from the tubular conduit to flow along a flow path of the flow control device into the annulus 114.

As shown in FIG. 1, the control unit 108 and the flow control device 112 may be implemented in separate housings, at different positions along the completion string 102. Alternately, the control unit 108 and the flow control device 112 may be integrated in a single shared housing.

Control units 108 and/or flow control devices 112 may be positioned in isolated portions of the well bore 106 and/or in continuous portions of the well bore 106 (i.e. portions that are not isolated by production packers 104). A control unit 108 positioned in an isolated portion of the well bore 106 may communicate with one or more flow control devices 112 positioned in the same isolated portion (as illustrated in FIG. 1) or another isolated portion of the well bore 106. In some instances, a control unit 108 can communicate with multiple flow control devices 112 in different isolated portions of the well bore 106.

In some implementations, the flow control device 112 may be in a first state when installed in the well system 100, and subsequently changed to a second, different state. The first and the second state may each correspond to a different mode of fluid communication between the interior region 116 and the annulus 114. For example, after installing the flow control device 112, the well system 100 may produce resources for a period of time with the flow control device 112 being in the first state. For example, the first state of the flow control device may correspond to a restricted flow path of an ICD in the flow control device 112 being open. After a period of time (e.g. 1 to 5 years), the composition of resources produced by the well system 100 may begin to change (e.g. the well system 100 may begin to produce significant amounts of water after three years of production), and it may be desirable to produce the well system 100 to completion by allowing inflow through a less restrictive bypass valve rather than through a restricted flow path. In the example, the control units 108 may be used to change the state of the flow control device 112 to a second state, where the second state corresponds to a bypass valve in the flow control device 112 being open.

Figure 4A:
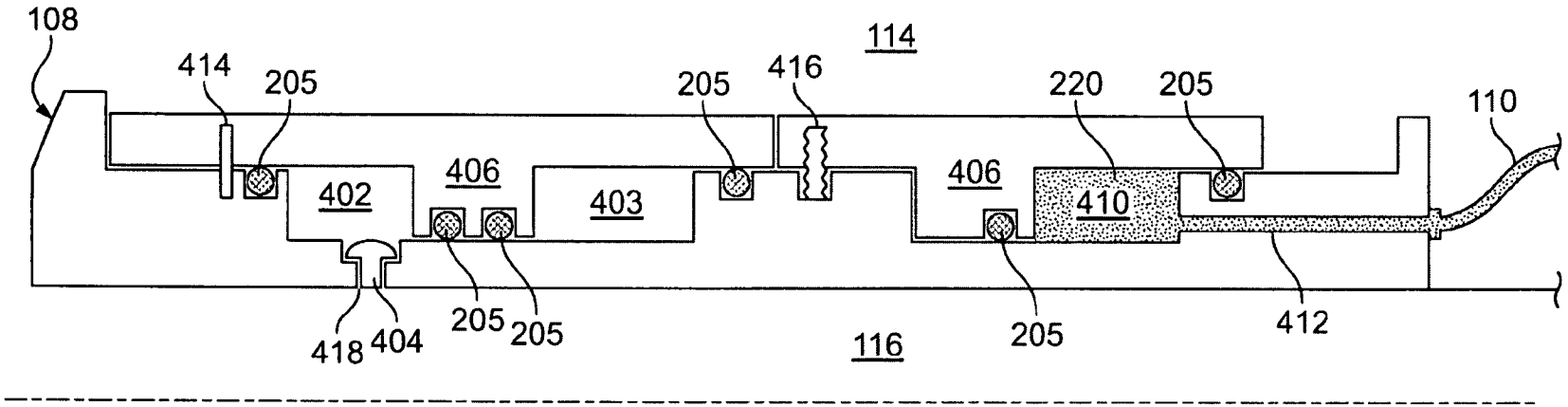
FIGS. 4A and 4B are diagrams illustrating a control unit in accordance with some aspects of the present disclosure.
Figure 4B:
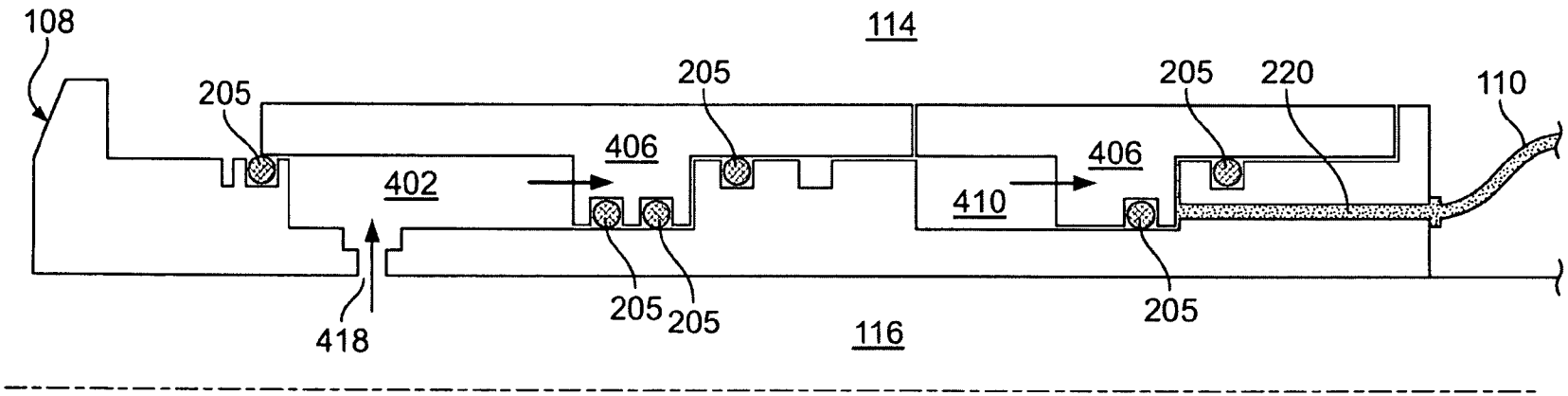

FIGS. 4A and 4B are diagrams illustrating a control unit 108 in accordance with some aspects of the present disclosure. The control unit 108 is not limited to any of the particular features or arrangement of features included in the illustrated example. In some implementations, when a rupture disk 404 of the control unit 108 is ruptured, the flow of fluid from the interior region 116 of the completion string 102 into a hydrostatic chamber 402 of the control unit 108 causes hydraulic fluid 220 from a hydraulic chamber 410 to be communicated to the flow control device 112, for example through the control line 110. The hydraulic fluid 220 communicated into the flow control device 112 may change the flow control device 112 from one of the plurality of states to a different one of the plurality of states, for example by changing the position of a control valve. The rupture disk 404 may be configured to rupture when the pressure across the rupture disk 404 exceeds a specified threshold value.

In some implementations, one or more control units may be installed in the well system 100 with the rupture disks 404 intact, blocking flow from the interior region 116 of the completion string 102 into the hydrostatic chamber 402 of the control unit 108, and the well system 100 may produce resources for a period of time with the rupture disks 404 intact. After the period of time, it may be desirable to change the state of one or more flow control devices 112, and pressure may be applied to fluids in the interior region 116 of the completion string 102. When the applied pressure exceeds the specified threshold value, the rupture disk may rupture, which may cause hydraulic fluid 220 to be communicated to the flow control device 112, which may change the state of the flow control device 112.

A flow control system may include a collection of control units 108, control lines 110, and flow control devices 112. FIGS. 5A, 5B, 7A, 7B, and 7C illustrate exemplary flow control systems in accordance with some aspects of the present disclosure. In some implementations a single control unit 108 may communicate with multiple flow control devices 112. For example, a single control unit 108 may be used to change the state of multiple flow control devices 112. In some implementations, multiple control units 108 may communicate with a single flow control device 112. For example, a first control unit 108 may be used to change the flow control device 112 from a first state to a second state, and a second control unit 108 may be used to change the flow control device 112 to yet another state or back to the first state. In a configuration with multiple control units 108, one or more of the different control units 108 may have rupture disks of different specified rupture pressures. Thus, as is discussed in more detail below, the control units 108 can be separately controlled by controlling the pressure in the interior region 116 of the completion string 102.

Returning now to FIG. 1, the well system 100 includes a horizontally oriented well bore 106. However, the illustrated well system 100 is only a representative example of one well system in which the principles of the present disclosure may be beneficially utilized. The principles of the present disclosure may be implemented in well bores of various configurations and orientations (e.g. inclined, inverted, horizontal, vertical, etc.). Indeed, with regard to all figures, the illustrated implementations are merely representative examples of useful applications of the principles of the present disclosure, and the principles of the present disclosure are not limited to any specific details of the illustrated implementations.

The well bore 106 may be cased or open-hole. In some implementations, gravel packs may be provided about any or all of the flow control devices 112. A variety of additional well equipment (such as valves, sensors, pumps, control and actuation devices, etc.) may also be provided in the well system 100. The well bore 106 may be used to extract resources (e.g. oil, water, natural gas, or other resource) from a subterranean formation, such as a petroleum-bearing formation (e.g. sandstone, Austin chalk, or other type of formation).

Figure 2A:
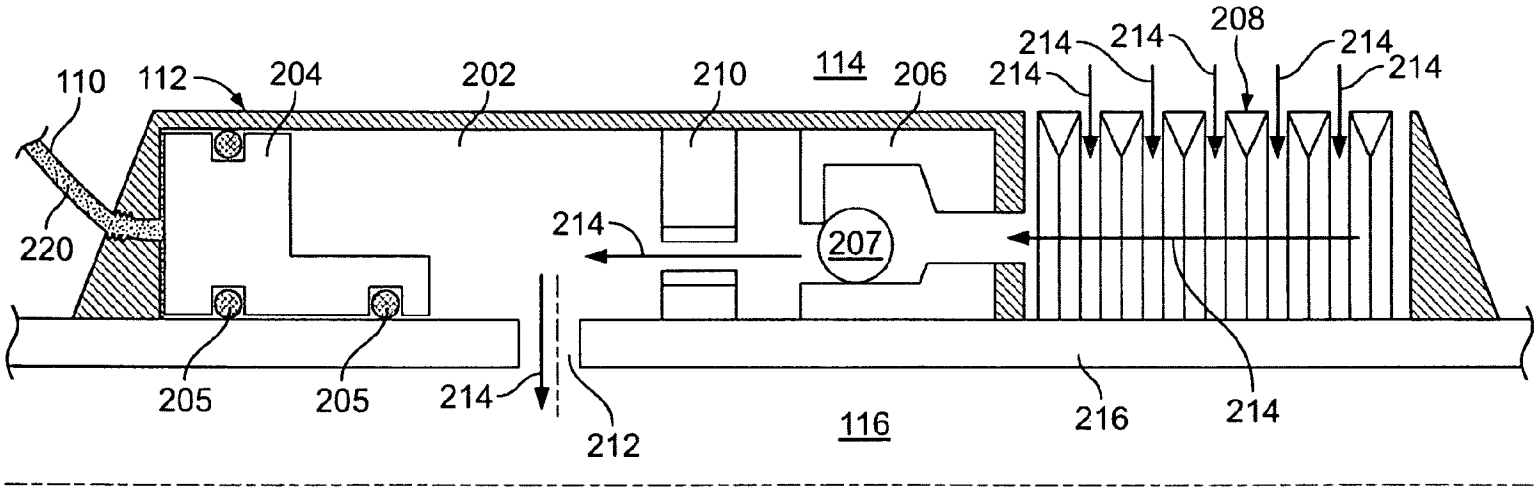
FIGS. 2A and 2B are diagrams illustrating a flow control device in accordance with some aspects of the present disclosure.
Figure 2B:
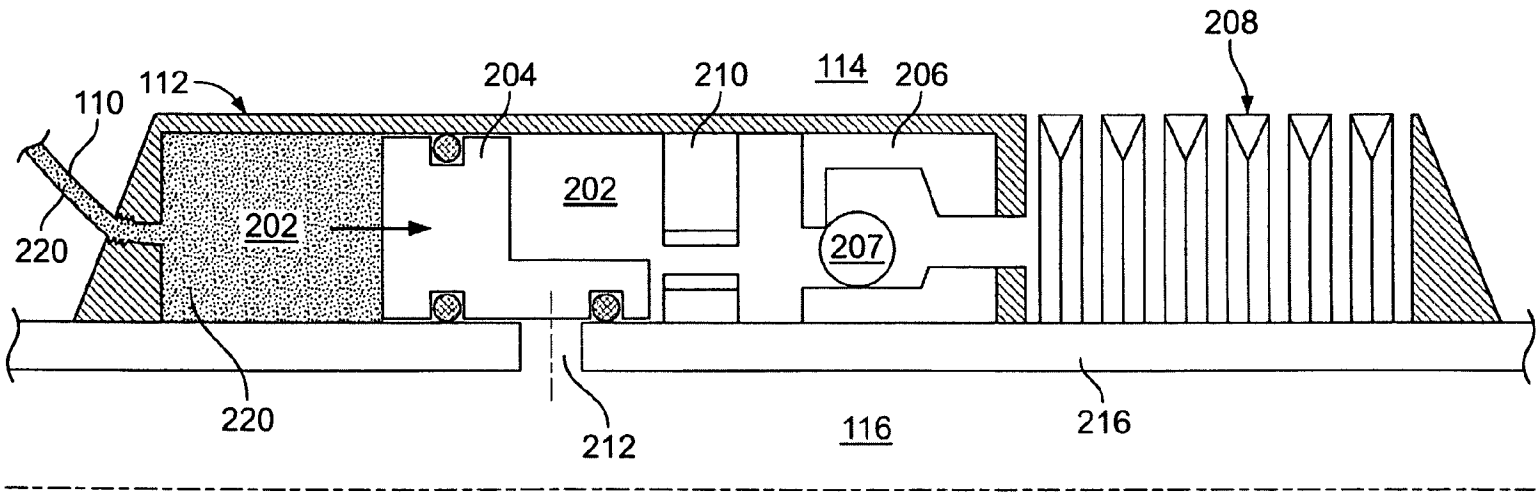

Referring to FIG. 2A, the illustrated example flow control device 112 includes a control valve chamber 202 and a control valve gate 204. In FIG. 2A, the control valve gate 204 is illustrated in a first position in the control valve chamber 202. In FIG. 2B, the control valve gate 204 is illustrated in a second position in the control valve chamber 202. When the control valve gate 204 is in the first gate position, fluid may flow from the annulus 114 to the interior region 116. When the control valve gate 204 is in the second gate position, the gate 204 may prevent fluid flow between the interior region 116 and the annulus 114.

While the illustrations are described with regard to a first gate position and a second gate position, the control valve gate 204, in general, may be in any position in the control valve chamber 202. The first gate position refers to any position of the control valve gate 204 that allows fluid to flow between the control valve chamber 202 and the interior region 116 through a port 212. The second gate position refers to any position of the control valve gate 204 that substantially impedes fluid flow through the port 212. In some implementations, the first position may be the position of the gate 204 when the flow control device 112 is first installed in the well system 100. The first gate position may correspond to a first state of the flow control device 112. The second gate position may correspond to a second state of the flow control device 112. The gate 204 may be moved to the second gate position, for example, by hydraulic fluid communicated from the control line 110 into the control valve chamber 202 at some time after the flow control device 112 has been installed in the well system 100.

The illustrated flow control device 112 also includes a check valve 206 that may allow fluid to flow from the annulus 114 to the interior region 116 when the control valve gate 204 is in the first gate position. The check valve 206 may prevent fluid flow from the interior region 116 into the annulus 114. The check valve 206 includes a stopper 207. A sand screen 208 in the flow path between the annulus 114 and the check valve 206 prevents particulates (e.g. sand and/or rock) from entering the interior region 116 from the annulus 114. The sand screen 208 may be any type of filtration device, such as a wire or mesh sand screen, perforated or slotted tubing, and/or other filtration device.

An inflow control device (ICD) 210 positioned in the flow path between the check valve 206 and control valve chamber 202 may control the rate of fluid flow from the annulus 114 into the interior region 116. The ICD 210 may be any annular device that controls a flow rate through the device for a given pressure across the device. For example, the ICD 210 may be a tube, nozzle, orifice, helical channel or any other type of inflow control device. The port 212 provides a flow path between the control valve chamber 202 and the interior region 116.

The arrows 214 illustrate a flow path between the annulus 114 and the interior region 116. When the control valve gate 204 is in the first gate position, fluids (e.g. oil, water, natural gas, and/or others) may flow from the annulus 114 through the sand screen 208, through the check valve 206, through the ICD 210, through the control valve chamber 202, through the port 212, and into the interior region 116. However, the check valve 206 may prevent fluid from traversing the inverse path (i.e. from the interior region 116 into the annulus 114). For example, the check valve may allow fluid to flow from the annulus 114 into the tubular conduit and reduce (or prevent) a flow of fluid from the tubular conduit into the annulus 114.

The control line 110 may be in fluid communication with the control valve chamber 202. The control line 110 may contain hydraulic fluid 220. When hydraulic fluid 220 is communicated into the control valve chamber 202, the control valve gate 204 may move to a different position in the control valve chamber 202. The hydraulic fluid 220 may be communicated from the control line 110, for example, due to the communication of hydraulic fluid into the control line 110 from the control unit 108 (of FIG. 1). The control valve gate 204 includes seals 205 which may prevent hydraulic fluid 220 from substantially leaking past the control valve gate 204.

When a sufficient amount of hydraulic fluid 220 is communicated into the control valve chamber 202, the control valve gate 204 may be moved to the second gate position. FIG. 2B illustrates the control valve gate 202 in the second gate position, blocking flow through the port 212, and a portion of the control valve chamber 202 is filled with hydraulic fluid 220. The flow control device 112 of FIGS. 2A and 2B may, in some implementations, provide an ICD 210 (e.g. which may be used to produce resources at a certain flow rate for some amount of time) that can be closed without well intervention, for example, using the control unit 108.

Figure 3A:
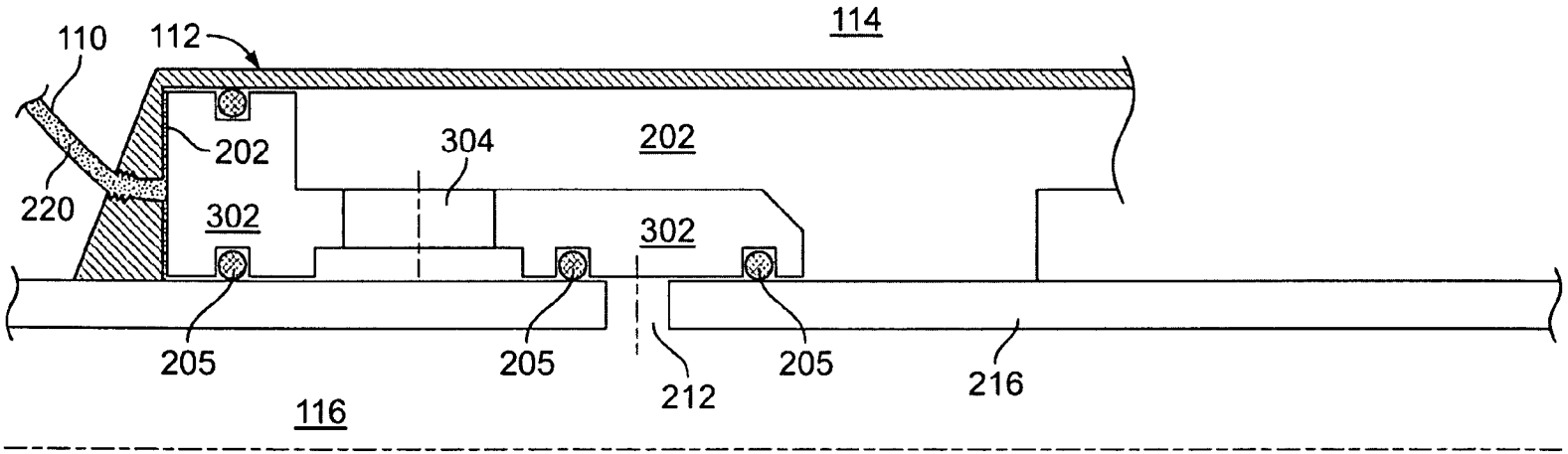
FIGS. 3A and 3B are diagrams illustrating a flow control device in accordance with some aspects of the present disclosure.

FIG. 3A illustrates a portion of the flow control device 112 in accordance with some aspects of the present disclosure. The flow control device 112 illustrated in FIG. 3A includes the control valve chamber 202, a control valve gate 302, and the port 212. The flow control device 112 also includes the control line 110 in fluid communication with the control valve chamber 202. The illustrated control valve gate 302 includes a port 304. The flow control device 112 of FIG. 3A may include any or all of the other features of the flow control device 112 illustrated in FIG. 2A. The flow control device 112 of FIG. 3A may also include additional features not illustrated in FIG. 2A. For example, a flow control device 112 need not include features such as a sand screen, an ICD, or a check valve; a flow control device 112 may include additional chambers, sensors, valves, screws, pins, seals, ports, and other features that are not illustrated in the figures.

Figure 3B:
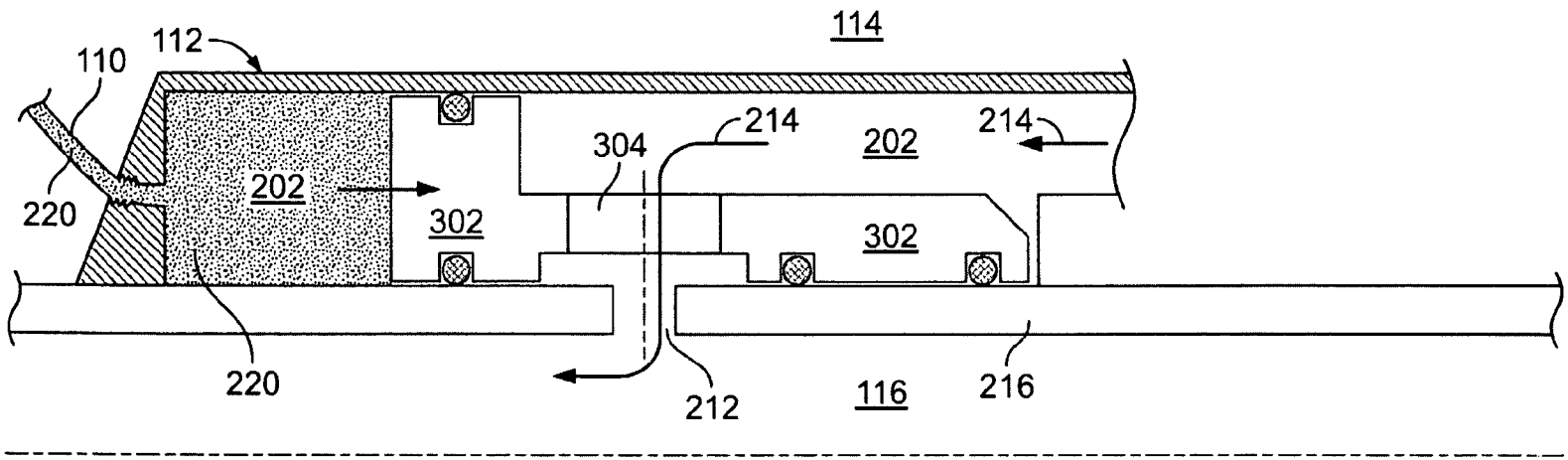

The control valve gate 302 of FIG. 3A is different from the control valve gate 204 of FIG. 2A. In particular, the control valve gate 302 in a first gate position (as illustrated in FIG. 3A) prevents fluid flow through the port 212. When the gate 302 is in a second gate position (as illustrated in FIG. 3B), the gate 302 allows fluid flow between the interior region 116 and the control valve chamber 202 through the ports 212 and 304. In some implementations, the first position may be the position of the gate 302 when the flow control device 112 is first installed in the well system 100. The first gate position may correspond to a first state of the flow control device 112. The second gate position may correspond to a second state of the flow control device 112. The gate 304 may be moved to the second gate position, for example, by the control unit 108 after the flow control device 112 has been installed in the well system 100.

When a sufficient amount of hydraulic fluid 220 is communicated into the control valve chamber 202, the control valve gate 302 may be moved to the second gate position. FIG. 3B illustrates the control valve gate 302 in the second gate position, allowing flow through the ports 212 and 304, and a portion of the control valve chamber 202 is filled with hydraulic fluid 220. The flow control device 112 of FIGS. 3A and 3B may, in some implementations, provide an bypass valve or an ICD that can be opened without well intervention (e.g. using the control unit 108) after installation in the well system 100.

Figure 9:
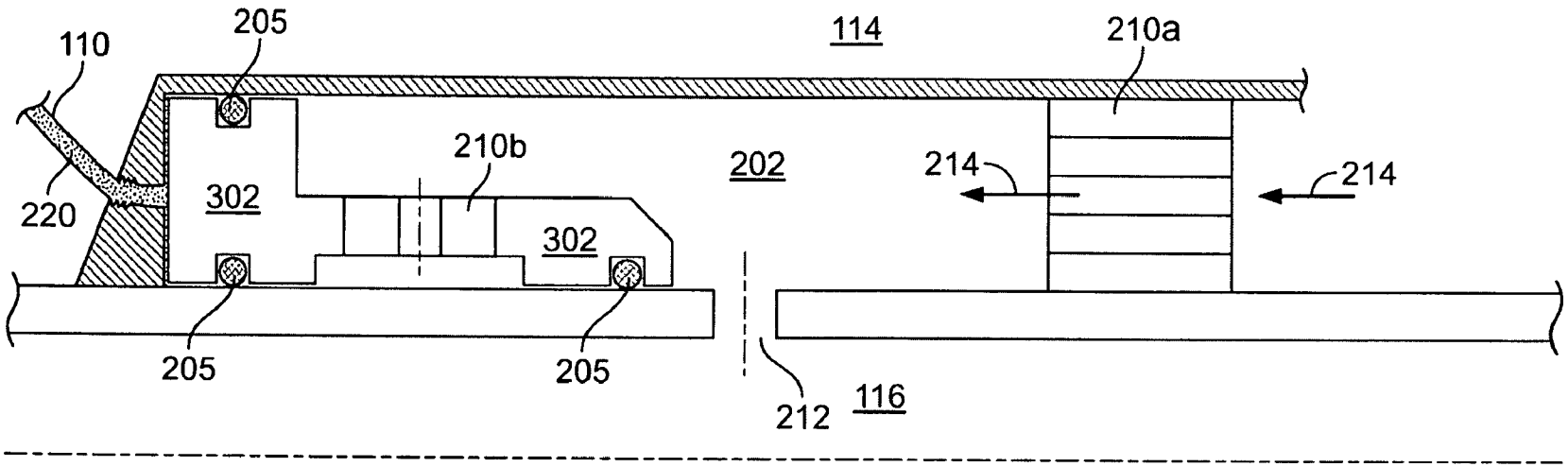
FIG. 9 is a diagram illustrating a flow control device in accordance with some aspects of the present disclosure.

FIG. 9 illustrates a portion of the flow control device 112 in accordance with some aspects of the present disclosure. The flow control device 112 illustrated in FIG. 9 includes the control valve chamber 202, a control valve gate 302, the port 212, and an ICD 210*a*. The flow control device 112 also includes the control line 110 in fluid communication with the control valve chamber 202. The illustrated control valve gate 302 includes an ICD 210*b*. The control valve gate 302 in a first gate position (as illustrated in FIG. 9) allows fluid flow through the port 212 and the ICD 210*a* at a rate determined at least partially by the specifications of the ICD 210*a*. In a second gate position (not illustrated), when the gate 302 abuts the ICD 210*a*, the gate 302 allows fluid flow through port 212, the ICD 210*b*, and the ICD 210*a* at a rate determined at least partially by the specifications of the ICD 210*a* and/or the specifications of the ICD 210*b*. In some implementations, changing the state of the device 112 changes a flow rate through the device 112. For example, the second state of the flow control device 112 may allow fluid to flow along a first flow path, and the second state of the flow control device 112 may allow fluid to flow along a second flow path. In some cases the first flow path is more flow restrictive than the second flow path. In other cases the first flow path is less flow restrictive than the second flow path. The ICD 210*a* may include the same, different, additional, or fewer features with respect to the ICD 210*b*.

FIG. 4A illustrates a control unit 108 in accordance with some aspects of the present disclosure. The control unit 108 includes a piston 406. The piston 406 may be in a first piston position or a second piston position. The piston 406 is illustrated in the first and second piston positions in FIGS. 4A and 4B, respectively. The piston 406 may be installed in multiple sections. The piston 406 (or each section of the piston 406) may be held in the first piston position by a shear pin 414 and/or a shear screw 416. Generally, a control unit 108 may include additional features not illustrated in the figures, or a control unit 108 may exclude some of the features illustrated in the figures. For example, a control unit 108 may include additional chambers, sensors, valves, screws, pins, seals, ports, and other features that are not illustrated in the figures.

In addition, a control unit 108 may include some or all of the features in any arrangement suitable for changing the state of a flow control device 112.

A hydraulic fluid chamber 410 is illustrated in fluid communication with the control line 110 through a hydraulic channel 412. When the piston 406 moves from the first piston position to the second piston position, hydraulic fluid 220 may be communicated into the control line 110. Consequently, the volume of fluid may be communicated to the flow control device 112. The volume of fluid may be sufficient to change the state of the flow control device 112, for example by displacing the control valve gate 204 of FIG. 2A (or the control valve gate 302 of FIG. 3A) from the first gate position to the second gate position.

The control unit 108 illustrated in FIG. 4A includes a hydrostatic chamber 402. A port 418 may provide a flow path between the interior region 116 and the hydrostatic chamber 402. In some implementations, the flow of a volume of fluid (e.g. a volume of fluid greater than the volume of the hydrostatic chamber 410) from the interior region 116 into the hydrostatic chamber 402 displaces the piston 406 from the first piston position to the second piston position. The rupture disk 404 may prevent fluid from flowing through the port 418. In some implementations, when the rupture disk 404 is intact, the hydrostatic chamber 402 may be at an atmospheric pressure (e.g. 15 psi), and the pressure in the interior region 116 may significantly exceed the atmospheric pressure (e.g. 500 psi), such that the differential pressure across the rupture disk 404 is essentially the absolute pressure of the interior region 116.

The rupture disk 404 may be ruptured, for example, when the pressure of fluids in the interior region 116 of the completion string 102 exceeds a certain threshold pressure. After the rupture disk 404 has ruptured, fluid may flow from the interior region 116 into the hydrostatic chamber 402. The flow of fluid in to the hydrostatic chamber 402 may displace the piston 406 from the first piston position to the second piston position. The displacement of the piston 406 from the first piston position to the second piston position may communicate fluid from the hydraulic chamber 410 through the hydraulic channel 412, into the control line 110. FIG. 4B illustrates the control unit 108 of FIG. 4A with the piston 406 in the second piston position, for example, after the rupture disk 404 (not illustrated in FIG. 4B) has ruptured.

In some implementations, the control unit 108 is actuated to change the flow control device 112 (e.g., from a first state to a second state) in response to pressure in the well bore 106. The pressure in the well bore 106 that actuates the control unit 108 can be a high pressure, a low pressure, a pressure cycle, a pressure spike, a pressure plateau, a pressure differential across a boundary, or another type of pressure of fluid in the well bore 106. For example, the control unit 108 may be actuated to change the flow control device 112 in response to pressure in the tubular conduit exceeding a specified pressure. In another example, the control unit 108 is actuated to change the flow control device 112 in response to pressure in the tubular conduit being less than a specified pressure. The illustrated example control unit 108 in FIG. 4A is actuated when the differential pressure in the interior region 116, as compared to the pressure in the chamber 402, exceeds a specified pressure. A person of ordinary skill in the art will understand how to modify the example control unit 108 to be actuated by different types of pressures in the well bore 106. For example, in FIG. 4A, the chamber 402 could be a high pressure chamber, and the control unit 108 could be actuated when the differential pressure in the interior region 116, as compared to the pressure in the chamber 402, is less than a specified value.

The control unit 108 illustrated in FIGS. 4A and 4B may be used to change the state of one or more flow control devices 112, for example, those illustrated in FIGS. 2A, 2B, 3A, 3B, and 6. The control unit 108 may be installed below a production packer 104 of the well system 100, and the rupture disk 404 may be ruptured without well intervention. The control unit 108 may be installed and operated without the use of control lines extending to the ground surface.

Figure 5A:
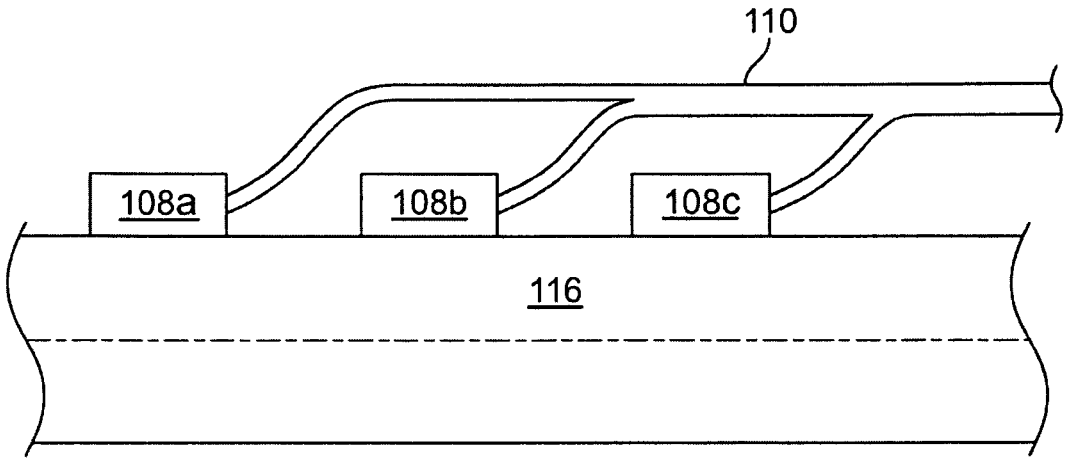
FIGS. 5A and 5B are diagrams illustrating flow control systems in accordance with some aspects of the present disclosure.

FIG. 5A illustrates a plurality of control units 108*a*, 108*b*, and 108*c* in fluid communication with a common control line 110. While only three control units 108 are illustrated, any number of control units 108 may be in fluid communication with a common control line 110 according to the present disclosure. The control line 110 may also be in fluid communication with one or more flow control devices 112 (which are not illustrated in FIG. 5A). In some implementations, each of the one or more of the control devices may include a rupture disk 404, where each rupture disk 404 is configured to rupture at a different pressure.

For example, control line 110 may be in fluid communication with a flow control device 112 that has four states. Control unit 108*a* may include a rupture disk 404 configured to rupture at a pressure of 1000 pounds per square inch (psi), control unit 108*b* may include a rupture disk 404 configured to rupture at 1050 psi, and control unit 108*c* may include a rupture disk 404 configured to rupture at 1100 psi. In this example, the flow control device 112 may be in a first state when it is installed in the well system 100. After the flow control device 112 is installed, a pressure exceeding 1000 psi and less than 1050 psi may be applied to fluids in the interior region 116 of the tubular conduit 102, rupturing the rupture disk 404 of control unit 108*a* and changing the flow control device 112 from the first state to a second state. When the flow control device is in the second state, a pressure between 1050 psi and 1100 psi may be applied to fluids in the interior region 116 of the tubular conduit 102, rupturing the rupture disk 404 of control unit 108*b* and changing the flow control device 112 from the second state to a third state. When the flow control device is in the third state, a pressure exceeding 1100 psi may be applied to fluids in the interior region 116 of the tubular conduit 102, rupturing the rupture disk 404 of control unit 108*c* and changing the flow control device 112 from the third state to a fourth state.

This example system (i.e. the flow control device 112 having four states) may be useful for controlling the flow of fluid into the completion string 102 at various stages in the production lifetime of the well system 100. For example, the first state of the flow control device 112 may be a closed state that does not allow fluid to flow into tie completion string 102 through the flow control device 112. The second state of the flow control device 112 may provide a flow path comprising an open bypass valve between the interior region 116 and the annulus 114. The open bypass valve may be used to gravel pack to well. The third state of the flow control device may close the bypass valve and provide a flow path comprising an ICD between the interior region 116 and the annulus 114. Resources may be produced from the well system through the open ICD for example, over a number of years. The fourth state of the flow control device may increase the rate of fluid flow from the annulus 114 into the interior region 116 by providing a shorter open path through the ICD than is provided by the third state.

Figure 5B:
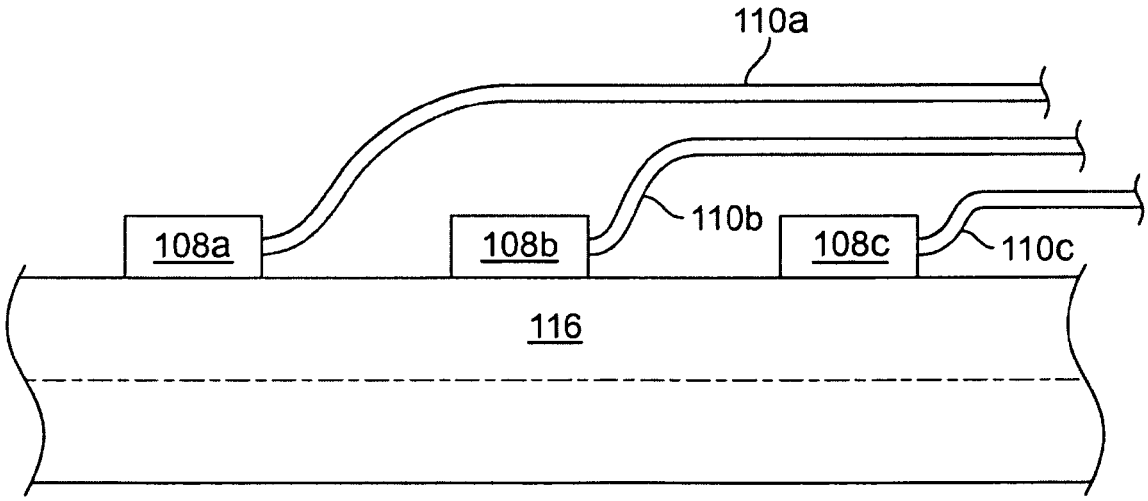

FIG. 5B illustrates a plurality of control units 108*a*, 108*b*, and 108*c* in fluid communication with control lines 110*a*, 110*b*, and 110*c*, respectively. While only three control units 108 are illustrated, any number of flow control units 108 may be in fluid communication with separate control lines 110 according to the present disclosure. Each control line 110 may also be in fluid communication with one or more flow control devices 112 (which are not illustrated in FIG. 5B).

In some implementations, each of the one or more of the control devices may include a rupture disk 404, where each rupture disk 404 is configured to rupture at a different pressure. In some implementations, one or more of the rupture disks 404 may be configured to rupture at the same pressure. All of the control lines 110 may be in fluid communication with different flow control devices 112. Alternatively, one or more of the control lines 110 may be in fluid communication with the same flow control device 112. In some implementations, for example, all of the control lines 110 may be in fluid communication with a first control device 112, while only control lines 110*a* and 110*b* are in fluid communication with a second flow control device 112.

Figure 6:
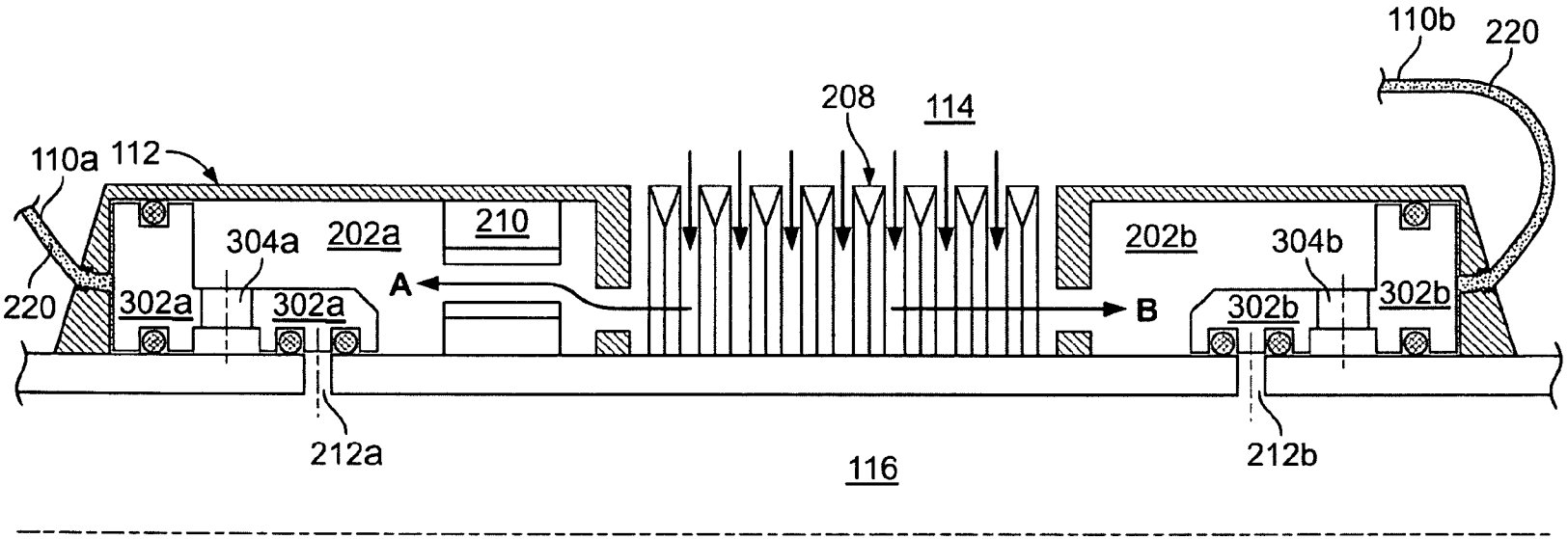
FIG. 6 is a diagram illustrating a flow control device in accordance with some aspects of the present disclosure.

FIG. 6 illustrates an example flow control device 112 that has four states, where three of the four states provide a different flow path between the annulus 114 and the interior region 116. Flow control device 112 may be in fluid communication with a first control unit 108 and a second control unit 108 through control lines 110*a* and 110*b*, respectively. Control lines 110*a* and 110*b* may be distinct control lines, for example, as illustrated in FIG. 5B. The flow control device 112 provides two flow paths between the annulus 114 and the interior region 116. Flow path A (illustrated by arrow A) includes the sand screen 208, the ICD 210, the control valve chamber 202*a*, and the ports 304*a* and 212*a*. Flow path B (illustrated by arrow B) includes the sand screen 208, the control valve chamber 202*b*, and the ports 304*b* and 212*b*. Either or both of the flow paths A and B may include additional features that are not illustrated for purposes of clarity (e.g. ports, valves, chambers, seals, ICDs, etc).

The flow control device 112 is illustrated in FIG. 6 in a first state, which includes the control valve gate 302*a* in a first gate 302*a* position and the control valve gate 302*b* in a first gate 302*b* position. The first state of the flow control device 112 prevents fluid flow along both paths A and B. Second, third, and fourth states of the flow control device 112 may allow fluid flow along path A and/or path B. For example, a second state may correspond to control valve gate 302*a* in a second gate 302*a* position and the control valve gate 302*b* in the first gate 302*b* position, allowing fluid to flow from the annulus 114 into the interior region 116 along path A. Similarly, a third state may correspond to control valve gate 302*a* in the first gate 302*a* position and the control valve gate 302*b* in a second gate 302*b* position, allowing fluid to flow from the annulus 114 into the interior region 116 along path B. A fourth state may correspond to both control valve gates 302*a* and 302*b* in their respective second gate positions, allowing fluid to flow from the annulus 114 into the interior region 116 along both paths A and B.

The flow control device 112 may be installed in the well system 100 in the first state, as illustrated. Hydraulic fluid 220 communicated into the control valve chamber 202*a* from control line 110*a* may move the control valve gate 302*a* from the first gate 302*a* position to a second gate 302*a* position in order to allow fluid to flow along path A, through port 304*a*. Additionally or alternatively, hydraulic fluid 220 communicated into the control valve chamber 202*b* from control line 110*b* may move the control valve gate 302*b* from the first gate 302*b* position to a second gate 302*b* position in order to allow fluid to flow along path B, through port 304*b*.

Figure 7A:
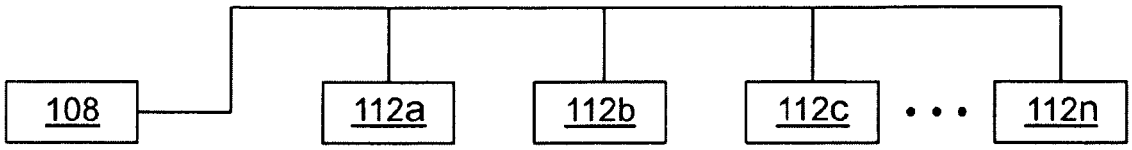
FIGS. 7A, 7B and 7C are diagrams illustrating flow control systems in accordance with some aspects of the present disclosure.
Figure 7B:
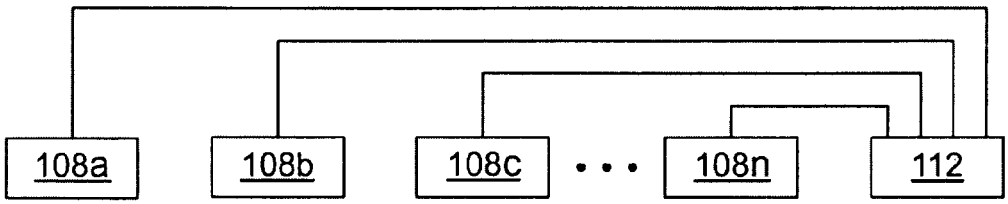
Figure 7C:
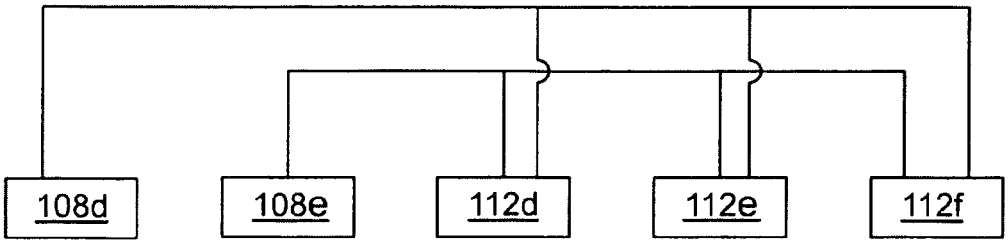

FIGS. 7A, 7B, and 7C are diagrams schematically illustrating three different configurations of a flow control system. FIG. 7A illustrates a "one control unit to n flow control device" (1:n) configuration. In a (1:n) configuration, a single control unit 108 is in fluid communication with n flow control devices 112*a*-112*x*. The (1:n) configuration may be useful for simultaneously changing the state of n flow control devices 112. FIG. 7B illustrates an "n control unit to one flow control device" (n:1) configuration. In an (n:1) configuration, a single flow control device 112 is in fluid communication with n control units 108*a*-108*x*. The (n:1) configuration may be useful for selecting a particular state of a flow control device 112, where the flow control device 112 has n states. FIG. 7C illustrates a particular example of an "n control unit to m flow control device" (n:m) configuration. In an (n:m) configuration, m flow control devices 112 are in fluid communication with n control units 108. In the illustrated example (m=3, n=2), both of two control units 108*d* and 108*e* are in fluid communication with each of three flow control devices 112*d*, 112*e*, and 112*f*. The (n:m) configuration may be useful for simultaneously selecting a particular state of m flow control devices 112, where each of the m flow control devices 112 has n states. The well system 100 may implement one or more of the three configurations or any hybrid version of the three configurations illustrated in FIGS. 7A, 7B, and 7C. While the flow control systems are illustrated with control units 108 on the left and flow control devices 112 on the right, the various components of a flow control system may be installed in the well system 100 in any order according to the present disclosure. For example, the control unit 108 may be installed on either side of (or above or below) the flow control device 112.

Figure 8:
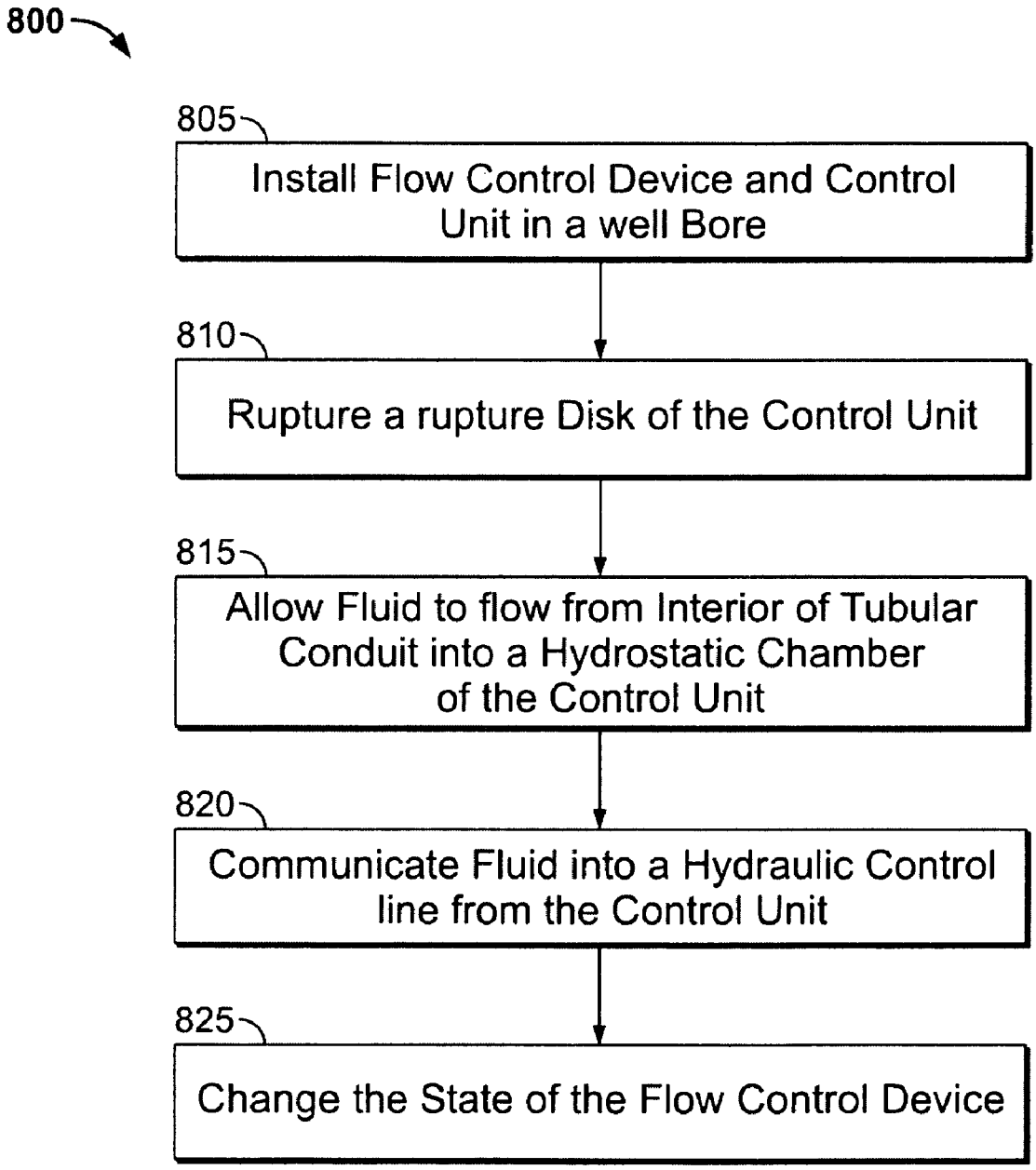
FIG. 8 is a flow chart illustrating a process for controlling fluid flow in a well system in accordance with some aspects of the present disclosure.

FIG. 8 is a flow chart illustrating a process 800 for controlling flow in a well system in accordance with some aspects of the present disclosure. In general, the process 800 may be used to open, close, or otherwise reconfigure flow paths between an annulus of a well bore into a tubular conduit installed in the well bore, where the annulus is the region between the tubular conduit and a wall of the well bore. In particular, the process 800 may be used to control a flow of fluid into the completion string 102 of the well system 100 of FIG. 1. Some or all of the functionality of the process 800 may be implemented without well intervention and/or without the use of control lines that extend to the ground surface.

At 805, a flow control device and a control unit are installed in a well system. As an example, the flow control device may be in a first state, which allows fluid to enter a tubular conduit at a certain rate (e.g. using an ICD). The flow control device in the first state may be used for some amount of time to produce resources from the well system. In this example, the well system may produce with the flow control device in the firsts state as long as the well system produces resources having a certain composition (e.g. primarily oil and/or gas). After some amount of time has elapsed (e.g. 3 years), the composition of the resources produced by the well system may begin to change (e.g. the well system may begin to produce large amounts of water). When the composition begins to change, it may be desirable to change the state of the flow control device. Changing the state of the flow control device may, for example, include opening a bypass valve or increasing a flow rate through an ICD.

As a different example, the flow control device may be installed in a closed state, meaning that no fluid can flow into the tubular conduit from the annulus through the flow control device. After installation, it may be desirable to change the state of the flow control device to a state that provides an open flow path between the annulus and the tubular conduit.

At 810, a rupture disk of the control unit is ruptured. The rupture disk may be configured to rupture when the pressure across the rupture disk exceeds a certain threshold pressure (e.g. 900 psi, 1000 psi, or 1100 psi). The rupture disk may be ruptured by applying a pressure exceeding the threshold pressure to fluids in the tubular conduit.

At 815, fluid is allowed to flow from an interior of a tubular conduit into a hydrostatic chamber of the control unit. The volume of fluid may exceed the initial volume of the hydrostatic chamber, causing the hydrostatic chamber to increase its volume, therein displacing a piston.

At 820, fluid is communicated into a hydraulic control line from the control unit. The fluid may be communicated into the hydraulic control line when a piston is displaced. The displacement of the piston may decrease the volume of a hydraulic chamber of the control unit.

At 825, the state of the flow control device is changed. The state of the flow control device may be changed when a volume of hydraulic fluid is communicated into a chamber of the flow control device from the control line. The volume of hydraulic fluid may be sufficient to open or close a valve of the flow control device. Changing the state of the flow control device may include opening or closing an ICD, opening or closing a bypass valve, and/or increasing or decreasing a flow rate through an ICD.

In some cases, at 825, the state of the flow control device is changed when fluid is communicated directly into the chamber of the flow control device from the control unit. For example, when the control unit and the flow control device are implemented in a shared housing, the operation (820) of communicating fluid into a hydraulic control line may be omitted.

The process 800 may perform any of the functions 805-825 and/or additional functions any number of times, according the present disclosure. For example, multiple flow control devices and/or control units may be installed in the well bore, and multiple rupture disks may be rupture in sequence or simultaneously. Furthermore, the process 800 may omit one or more of the functions 805-825.

A number of embodiments of the invention have been described. Nevertheless, it will be understood that various modifications may be made without departing from the spirit and scope of the disclosure. Accordingly, other embodiments are within the scope of the following claims.

What is claimed is:

1. A system for installation in a well bore, the system comprising:

a flow control device changeable from a first state to a second state, the first state corresponding to a first mode of fluid communication between an interior of a tubular conduit of a completion string and an annulus between the tubular conduit and a wall of the well bore and the second state corresponding to a second, different mode of fluid communication between the interior of the tubular conduit and the annulus; and a control unit coupled to the flow control device to change the flow control device between the first and second states, the control unit comprising a hydraulic chamber that holds a first fluid at a first pressure, the control unit actuated to change the flow control device in response to pressure in the interior of the tubular conduit in the well bore exceeding the first pressure by a specified amount.

2. The system of claim 1, wherein the control unit comprises:

a piston in communication with the hydraulic chamber and coupled to the flow control device, pressure in the hydraulic chamber moves the piston and moving the piston changes the flow control device from the first state to the second state.

3. The system of claim 1, wherein the first state of the flow control device allows fluid from the tubular conduit to flow along a first flow path of the flow control device into the annulus.

4. The system of claim 1, wherein the first state of the flow control device allows fluid from the annulus to flow along a first flow path of the flow control device into the tubular conduit.

5. The system of claim 4, wherein the second state of the flow control device allows fluid from the annulus to flow along a second flow path into the tubular conduit, the second flow path being less flow restrictive than the first flow path.

6. The system of claim 4, wherein the second state of the flow control device allows fluid from the annulus to flow along a second flow path into the tubular conduit, the second flow path being more flow restrictive than the first flow path.

7. The system of claim 1, wherein the first state of the flow control device prevents fluid flow between the annulus and the tubular conduit and the second state of the flow control device allows fluid flow between the annulus and the tubular conduit.

8. The system of claim 1, wherein the control unit resides below a packer of the completion string.

9. The system of claim 1, the flow control device further comprising a sand screen, the sand screen filtering particulates in the annulus from entering the tubular conduit.

10. The method of claim 1, wherein the first pressure is an atmospheric pressure.

11. A method comprising:

applying a first pressure in a well bore;

in response to the applied first pressure, changing a state of a first flow control device in a completion string installed in the well bore from a first state of the first flow control device to a second state of the first flow control device, the first state of the first flow control device corresponding to a first mode of fluid communication between an interior of the tubular conduit and the annulus between the tubular conduit and a wall of the well bore and the second state of the first flow control device corresponding to a second, different mode of fluid communication between the interior of the tubular conduit and the annulus;

applying a second pressure in the well bore; and in response to the applied second pressure, changing a state of a second flow control device in the completion string from a first state of the second flow control device to a second state of the second flow control device.

12. The method of claim 11, wherein changing the state of the first flow control device comprises communicating a volume of fluid to the first flow control device.

13. The method of claim 11, wherein the first state of the first flow control device allows fluid to flow along a first flow path of the first flow control device between the interior of the tubular conduit and the annulus and the second state of the first flow control device allows fluid to flow along a second flow path of the first flow control device between the interior of the tubular conduit and the annulus that is less restrictive to fluid flow than the first flow path.

14. The method of claim 11, wherein the first state of the first flow control device allows fluid to flow along a first flow path of the first flow control device between the interior of the tubular conduit and the annulus and the second state of the first flow control device allows fluid to flow along a second flow path of the first flow control device between the interior of the tubular conduit and the annulus that is more restrictive to fluid flow than the first flow path.

15. The method of claim 11, wherein the first state of the first flow control device is sealing against flow of fluid through the first flow control device between the interior of the tubular conduit and the annulus.

16. The method of claim 11, wherein the first flow control device comprises a sand screen in communication with an inflow control device.

17. A system for installation in a well bore, the system comprising:

a flow control device changeable from a first state to a second state, the first state corresponding to a first mode of fluid communication between an interior of a tubular conduit of a completion string and an annulus between the tubular conduit and a wall of the well bore and the second state corresponding to a second, different mode of fluid communication between the interior of the tubular conduit and the annulus;

a control unit coupled to the flow control device to change the flow control device between the first and second states, the control unit actuated to change the flow control device in response to pressure in the well bore;

a hydraulic chamber in communication with the interior of the tubular conduit;

a piston in communication with the hydraulic chamber and coupled to the flow control device, pressure in the hydraulic chamber moves the piston and moving the piston changes the flow control device from the first state to the second state; and a rupture disk between the hydraulic chamber and the interior of the tubular conduit, the rupture disk rupturing to allow fluid from the interior of tubular conduit into the hydraulic chamber when the pressure in the tubular conduit exceeds a specified pressure.

18. A system for installation in a well bore, the system comprising:

a flow control device changeable from a first state to a second state, the first state corresponding to a first mode of fluid communication between an interior of a tubular conduit of a completion string and an annulus between the tubular conduit and a wall of the well bore and the second state corresponding to a second, different mode of fluid communication between the interior of the tubular conduit and the annulus; and a control unit coupled to the flow control device to change the flow control device between the first and second states, the control unit actuated to change the flow control device in response to pressure in the well bore;

an additional flow control device changeable between a plurality of states and providing one or more flow paths between the annulus and the interior of the tubular conduit, the control unit coupled to the additional flow control device to change the additional flow control device between the states in response to pressure in the well bore.

19. A system for installation in a well bore, the system comprising:

a flow control device changeable from a first state to a second state, the first state corresponding to a first mode of fluid communication between an interior of a tubular conduit of a completion string and an annulus between the tubular conduit and a wall of the well bore and the second state corresponding to a second, different mode of fluid communication between the interior of the tubular conduit and the annulus;

a first control unit coupled to the flow control device to change the flow control device between the first and second states, the control unit actuated to change the flow control device in response to a first pressure in the well bore; and a second control unit coupled to the flow control device to change the flow control device between a third state and at least one of the first state or the second state, the second control unit actuated to change the flow control device in response to a second pressure in the well bore.

20. A system for installation in a well bore, the system comprising:

a flow control device changeable from a first state to a second state, the first state corresponding to a first mode of fluid communication between an interior of a tubular conduit of a completion string and an annulus between the tubular conduit and a wall of the well bore and the second state corresponding to a second, different mode of fluid communication between the interior of the tubular conduit and the annulus, the flow control device comprising a check valve that allows fluid to flow from the annulus into the tubular conduit and prevents a flow of fluid from the tubular conduit into the annulus; and a control unit coupled to the flow control device to change the flow control device between the first and second states, the control unit actuated to change the flow control device in response to pressure in the well bore.

21. A method comprising:

applying pressure in a well bore; and in response to the applied pressure, changing a state of a flow control device in a completion string installed in the well bore from a first state to a second state, the first state corresponding to a first mode of fluid communication between an interior of the tubular conduit and the annulus between the tubular conduit and a wall of the well bore and the second state corresponding to a second, different mode of fluid communication between the interior of the tubular conduit and the annulus, wherein changing the state of the flow control device is prevented prior to rupturing a rupture disk, the rupture disk configured to rupture in response to a specified pressure in the well bore.

* * * * *